United States Patent [19]

Fritchman

[11] 4,352,377

[45] Oct. 5, 1982

[54] COMPRESSOR DISCHARGE VALVE

[75] Inventor: Jack F. Fritchman, Cullman, Ala.

[73] Assignee: White Consolidated Industries, Inc., Cleveland, Ohio

[21] Appl. No.: 287,354

[22] Filed: Jul. 27, 1981

[51] Int. Cl.[3] ..... F16K 15/14

[52] U.S. Cl. ..... 137/851

[58] Field of Search ..... 137/851, 852, 855, 856, 137/857, 512.15, 512.4; 417/569

[56] References Cited

U.S. PATENT DOCUMENTS

| | | | |
|---|---|---|---|
| 1,688,185 | 10/1928 | Hazard | 137/851 |
| 1,707,306 | 4/1929 | Holdsworth | 137/857 |
| 2,064,754 | 12/1936 | Ivens | 137/855 |
| 2,089,706 | 8/1937 | Orr | 137/852 |
| 2,118,356 | 5/1938 | Money | 137/856 |
| 2,970,608 | 2/1961 | Doeg | 137/516.11 |
| 3,039,487 | 6/1962 | Doeg | 137/516.11 |
| 3,109,451 | 11/1963 | Mihalakis | 137/851 |
| 3,200,838 | 8/1965 | Sheaffer | 137/856 |
| 3,926,214 | 12/1975 | Hrabal | 137/856 |
| 4,257,457 | 3/1981 | Namura et al. | 137/856 |

*Primary Examiner*—H. Jay Spiegel

*Attorney, Agent, or Firm*—Pearne, Gordon, Sessions, McCoy & Granger

[57] ABSTRACT

A discharge valve assembly for a compressor includes a valve plate having a pair of projecting guideposts. A discharge port is located in said valve plate closer to one of the posts than the other post and a stop member is mounted on the guidepost to define a stop surface spaced from the surface of the valve plate. Between the stop member and the valve plate are a flat valve reed and a bowed valve spring, and the stop surface adjacent the guidepost nearest the valve seat is spaced farther from the valve plate than the stop surface adjacent the other guidepost.

9 Claims, 4 Drawing Figures

COMPRESSOR DISCHARGE VALVE

BACKGROUND OF THE INVENTION

This invention relates generally to hermetic refrigeration compressors and, more particularly, to discharge valves for relatively small size refrigeration compressors of the type used in household appliances.

Hermetic refrigeration compressors are used in a large number of household appliances, such as refrigerators and food freezers. Most of these compressors use a single reciprocating piston operating on a horizontal axis and driven by a relatively high-speed, two-pole, electric motor at a nominal 3600 r.p.m. The cylinder in which the piston reciprocates has a cylinder head incorporating intake and discharge valves, and these valves are almost universally of the reed-type using a flat strip of springlike material to close off the intake or discharge port. Normally, these compressors use a single valve plate having a suction valve located on the piston side of the valve plate and a discharge valve located on the outer side of the valve plate in a discharge plenum chamber, which in turn is connected to the discharge line through a muffler arrangement.

The suction and discharge valves operate under different conditions, and therefore are generally quite different in construction. The suction valve operates at a relatively low pressure differential, i.e., the pressure existing within the sealed case of the compressor which is connected to the return line of the system and that pressure within the cylinder when the piston is on the suction stroke. Since the case pressure is relatively low, the pressure differential across the suction valve is also relatively low, and for proper efficiency, the suction port is generally relatively large in diameter, and therefore requires that the reed valve have a relatively large sealing surface. However, the suction valve is able to remain open over a substantial length of the suction stroke, and generally will not close until after the piston has gone through the bottom reversal and begun the compression stroke, and the increasing pressure inside the cylinder as the compression stroke begins assists the spring action of the reed in the suction valve to aid in the closing action. Thus, in general, suction valves tend to be much larger and generally use a cantilever-type construction for the reed.

On the otherhand, the discharge valve operates under quite different conditions. Except during initial start-up conditions, the pressure in the discharge plenum will be relatively high under steady-state operation conditions, and the discharge valve will not and cannot open until the pressure within the pumping cylinder exceeds the discharge pressure and the biasing force holding the discharge valve in a closed position. Thus, the discharge valve will not open until the piston has completed a substantial portion of its compression stroke, and after the piston reaches the end of the compression stroke, the discharge valve must close very quickly as the motion of the piston reverses to prevent high-pressure gases in the discharge plenun from flowing back into the cylinder, a condition which can result in a substantial drop in the efficiency of the compressor. These conditions generally require that the discharge valves be relatively low in mass and operate through a relatively short range of movement; therefore, the design of the compressor discharge valve tends to become rather complex and a large number of designs have evolved to meet the varying conditions of different compressors.

One such design is shown in the patent of R. W. Doeg, U.S. Pat. No. 2,970,608, which utilizes a rigid stop member resiliently secured to the outside of the valve plate and a single valve reed which is secured to the posts mounting the stop member and movable to and from the valve plate which has a pair of discharge points arranged symmetrically with respect to the transverse centerline of the stop member and the mounting posts. This design has been used quite successfully in larger size refrigerator compressors in the $\frac{1}{4}$ to $\frac{1}{3}$ horsepower range, but efforts have been made to further improve the efficiency of the discharge valve in smaller compressors operating in the range of 1/6 or 1/5 horsepower. One such design is shown in the patent of R. W. Doeg, U.S. Pat. No. 3,039,487, which utilizes a mounting arrangement somewhat similar to that disclosed in U.S. Pat. No. 2,970,608 except that in place of the single valve reed it utilizes three separate members including two reeds operating back-to-back and a stiffer flexible stop member. With this valve, a high degree of efficiency is obtained in smaller compressors because of the two-stage action of the valve, in which, under initial pull-down conditions when the pressure in the discharge plenum is low, the high volume of gas will be discharged starting at the beginning of the compression stroke and the flexible stop is allowed to deflect to give increased travel for the valve reed to provide a higher opening at the discharge port. This larger travel still allows relatively prompt closing of the valve, since only the closure reed must move back against the valve plate as the piston reverses. When the pressure in the discharge plenum increases, as occurs under normal running conditions, the valve reed need not open as far and will not begin to open until the piston is moved farther along on the compression stroke. In this case, because of the higher pressure in the discharge plenum, the volume of gases to be discharged through the discharge valve will be relatively lower because of the increased pressure, and in such case the valve reed moves through a shorter distance and the flexible stop member will tend to deflect very little, if at all, during operation. Although the valve shown in U.S. Pat. No. 3,039,487 is disclosed as sealing against a pair of discharge ports, with a symmetrical arrangement with respect to the mounting pins, it has been found that such valve works equally well if one of the two discharge ports is eliminated and the other discharge port increased slightly in diameter while remaining in the same location as shown in the patent.

SUMMARY OF THE INVENTION

The present invention provides a compressor discharge valve which operates to provide a reduced amount of flow restriction for the refrigerant gas in passing from the compressor cylinder into the discharge plenum. The reduced restriction results in lower gas velocity and decreased pressure drop, therefore reducing the amount of power required by the compressor, and increasing the overall operating efficiency of the compressor.

The reed valve arrangement of this invention provides a higher maximum lift for the valve reed, to thereby decrease the flow restriction and increase the efficiency. Furthermore, the valve operates with a reduced amount of force required to open the valve under all operating conditions without sacrificing the response time to obtain prompt closing at the piston reversal at the end of the compression stroke. The arrangement of the reed and its biasing spring reduces sliding friction between the moving parts, while retaining a proper amount of damping on the valve reed to prevent undesirable modes of vibration, which can tend to increase noise, particularly when the valve closes, and thereby aid in maintaining acceptable low noise levels for compressor operation. Furthermore, the valve construction uses a minimum number of parts, thereby reducing cost and improving reliability for long compressor life.

The discharge valve assembly of this invention includes a valve plate having a discharge side exposed to a discharge plenum within the cylinder head of the compressor. The valve plate has a pair of spaced mounting posts extending into the plenum chamber and a single valve port and seat are positioned on the line between the posts but are located substantially closer to one of the posts than the other. Mounted on each of the posts is a flat, springlike valve reed above which is located a valve spring similar in shape to the valve reed but given a bowlike curvature so that it contacts the valve reed adjacent each of the posts and bows upwardly not only in the center but at each end extremity. Above the valve spring is a retainer or stop member of rigid material positioned against the valve plate by a keeper spring secured to the outer ends of both the posts and engaging the stop member at the center. The clearance between the stop member and the valve plate is such that at the post farthest from the valve seat, the end portion of the valve spring is somewhat compressed, while in the area adjacent to both the other post and the valve seat around the valve port the clearance is substantially greater so that the valve spring normally engages the stop only at the center of the bowed portion, while the bent, extreme end portion is out of contact with the stop member when the valve member is in the seated position. When the discharge valve is opened on the compression stroke, the reed valve moves upwardly with the force applied around the valve seat to assume an arcuate shape. At the same time, the valve spring moves upwardly to tend to flatten itself against the stop member and the extreme end of the valve spring then contacts the stop member to provide an increasing biasing force as the valve reed moves to a fully opened position. Because of the different modes of movement of the valve reed and the valve spring, there is a certain amount of sliding friction between them and between the valve spring and the stop plate to provide a damping action and eliminate unwanted modes of vibration to the valve reed. Because of the manner in which the valve spring flexes, it provides a nonlinear biasing force which is substantially proportionally greater when the valve is in the fully open position and which decreases in a nonlinear fashion as the valve reed moves back toward its seat to provide a minimum biasing force as the valve reed engages the seat to minimize any slapping or other noise resulting from contact between the reed and the valve plate.

DESCRIPTION OF THE PREFERRED EMBODIMENT

Figure 1:
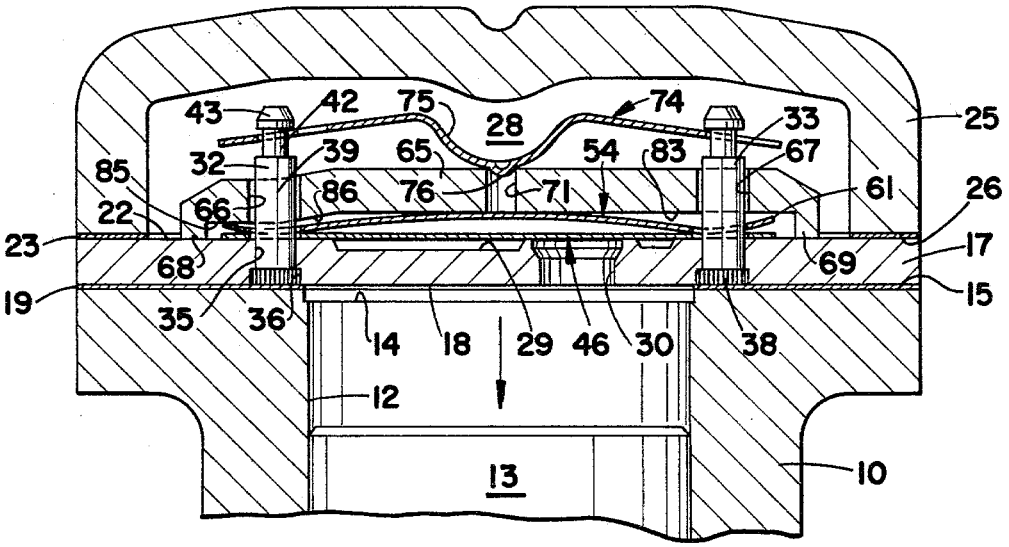
FIG. 1 is a cross-sectional view, partly broken away through the cylinder head and cylinder of a hermetic refrigeration compressor, showing the discharge valve in the closed position when the piston is moving on the suction stroke.

Referring to the drawings in greater detail, FIG. 1 shows a fragmentary, cross-sectional view of a refrigeration compressor cylinder block and head incorporating the discharge valve of the present invention. As shown in FIG. 1, a cylinder block 10 is shown only as the head end portion, since the remaining portion of the cylinder block may be of any conventional construction, as well known in the art. The cylinder block 10 has a cylinder bore 12 extending axially therein within which is mounted a piston 13 which is reciprocated by the usual crankshaft and connecting rod arrangement. At the outer end of cylinder bore 12 is a counterbore 14 adjacent the flat end face 15 of cylinder block 10.

Figure 3:
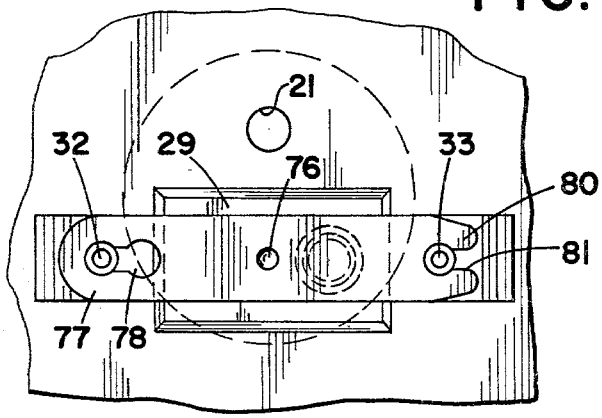
FIG. 3 is a fragmentary plan view of the compressor discharge valve shown in FIGS. 1 and 2.
Figure 4:
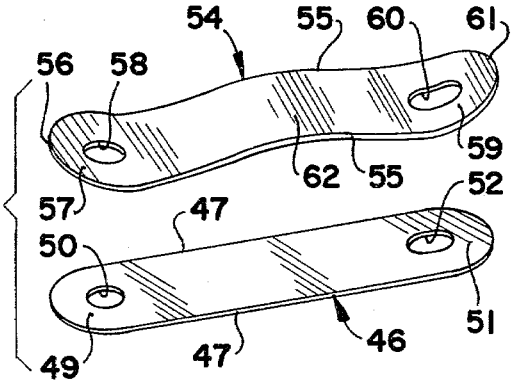
FIG. 4 is a perspective view of the valve reed and valve spring in the unstressed condition.

A valve plate 17 is mounted on the end of the cylinder block and secured thereto in a suitable manner, such as by cap screws (not shown), and has an inner side 18 facing the cylinder block end face 15 and a suitable gasket 19 is positioned therebetween for sealing purposes. It should be noted that the valve plate 17 includes a suction port 21 (see FIG. 3) and that normally a suitable suction valve would be positioned between the inner side 18 of the valve plate and the gasket 19, but no showing has been made of this since it forms no part of the present invention. The valve plate 17 has an outer side or face 22 which is generally formed to be parallel with the inner side or face 18 and serves to mount the discharge valve. Outwardly of the side 22 is a suitable sealing gasket 23 which engages a face 26 of the cylinder head 25. It will be understood that the cylinder head 25, the valve plate 17, and various gaskets therebetween are all clamped together against the cylinder block end face 15, and the cylinder head 25 defines a discharge plenum chamber 28 which is connected to the discharge line of the compressor.

The valve plate 17 has a discharge port 30 extending between the cylinder bore 12 and the plenum 28 and the outer side 22 of the valve plate 17 is provided with a recessed portion 29 extending around the discharge port 30 to leave a raised annular valve seat 31 around the discharge port 30 so that the valve seat 31 is coplanar with the outer side 22 of the valve plate.

The discharge valve assembly is mounted and positioned within the plenum 28 by means of a pair of mounting and guiding posts 32 and 33. These posts are fixedly mounted within bores 35 in the valve plate and the ends of the bores 35 adjacent the inner side 18 of the valve plate are provided with enlarged counterbores 36, which receive enlarged, serrated heads 38 of the posts so that when the posts are pressed into place with a press fit in the valve plate, the heads 38 will engage the counterbores 36 with the serrations to ensure more positive retention and axial positioning of the posts, as well as to prevent any rotational movement of the posts within the valve plate. Each of the posts 32 and 33 includes a cylindrical portion 39 extending upwardly or outwardly from the outer valve plate side 22 to terminate in a reduced diameter neck portion 42, beyond which is a slightly enlarged head portion 43. It will be understood that the two posts 32 and 33 are mounted symmetrically equidistant with respect to the centerline of the cylinder bore 12, and that the centerline defined by the two posts 32 and 33 is offset from the centerline to allow space for a suction plenum (not shown) about the suction port 21. Furthermore, the discharge port 30 is collinear with the two posts 32 and 33, and offset from the midpoint between the two posts by a distance approximately equal to one-sixth of the spacing between the two posts so that the distance of the discharge port 30 from the left post 32 is twice the distance from the right post 33 as defined by the centerlines of both the posts and the discharge port 30.

A valve reed 46 is mounted on the posts 32 and 33, and is made of a flat strip of spring steel of uniform thickness and flatness so as to lie normally in abutting contact with the outer side 22 of valve plate 17, and in particular in sealing contact with the valve seat 31 around the discharge port 30. The valve reed 46 has generally parallel sides 47 and has a width greater than the outer diameter of the valve seat 31. At the one end 49, the reed 46 has a round hole 50 somewhat larger in diameter than the diameter of the cylindrical post portion 39, while at the other end 51 there is a slightly elongated hole 52 to ensure positive clearance with the cylindrical portion 39 of the other post to allow the reed freedom to flex and change slightly in length as it opens and closes against the discharge port valve seat 31.

A valve spring 54 is positioned on the posts 32 and 33 above the valve reed 46, and is formed of a flat strip of spring steel substantially identical in thickness and dimensions with the valve reed 46. Thus, the valve spring 54 has parallel sides 55 generally coextensive with the parallel sides 47 of the valve reed 46. At the one end 57 of the valve spring 54 is a round hole 58, while at the other end 59 is an elongated hole 60 so that the valve spring has the same fit and freedom of movement as the valve reed 46. However, the valve spring 54 is not flat, but rather has the center section 62 bowed upwardly away from the valve reed 46, and likewise the tips 56 and 61 of the two ends 57 and 59 are also bent upwardly, so that the actual point of normal contact against the valve reed 46 only occurs immediately adjacent the holes 58 and 60.

The valve spring 54 is compressed and held in place by means of a rigid valve stop member 65, which has a pair of openings 66 and 67 to make a loose fit over the posts 32 and 33. At the ends, the valve stop 65 has legs 68 and 69 which make abutting contact with the outer side 22 of valve plate 17. The valve stop 65 also has a small opening 71 at the center intermediate the openings 66 and 67. A spring retainer 74 in the form of a relatively stiff sheet of spring steel has an inwardly bowed center section 75 with a projecting dimple 76 to engage the opening 71 in the valve stop to position the spring retainer in place. The spring retainer 74 extends over and is received on the posts 32 and 33, and exerts a resilient biasing force to the bowed center section 75, pressing the valve stop 65 against the valve plate 17. At the end 77 of spring retainer 74 adjacent the post 32, the spring retainer has a keyhole slot 78 adapted to fit over the neck 42 of the post and be held against the underside of the head 43. At the other end 80 of the spring retainer is an open slot 81, also adapted to fit around the neck 42 of post 33 and held against the underside of the head 43. This arrangement allows easy assembly of the valve mechanism, since it is only necessary to place the valve reed 46 and valve spring 54 over the posts 32 and 33, to be followed by assembly of the valve stop 65 in like manner. The spring retainer 74 is then fitted over the posts 32 and 33, but to one side of the center, so that the dimple 76 is beside the center opening 71 in the valve stop. The ends 77 and 80 of the spring retainer are then depressed, with the end 77 positioned so that the large portion of the keyhold slot 78 fits over the head 43 of post 32, while the open slot 81 at the other end is held below the head 43 of the post 33. The spring retainer is then merely moved sideways until the dimple 76 engages the center opening 71 in the valve stop, and at that point the narrow portion of keyhole slot 78 will be beneath the head 43 of left post 32, while the open slot 81 will fit around the neck 42 of post 33 and under the head 43 so that both of the ends of the spring retainer will be depressed toward the valve plate 17 and hold the entire assembly in place. It should be understood that the spring retainer 74 could also be assembled from the opposite direction with the keyhole slot 78 adjacent the right post 33 in like manner. Furthermore, although the elongated holes of the valve reed 46 and valve spring 54 have been stated as being adjacent the right post 33, this is not critical and the valve functions equally well if the positions of either or both the valve reed 46 and valve spring 54 are reversed so that the elongated holes are around the left post 32. It is only important that the valve stop 65 be positioned as shown with respect to the discharge port 30 for the reasons to be described hereinafter.

The valve stop 65 has on its underside a stop surface 83 extending from the end adjacent the right post 33, almost to the left post 32. This stop surface 83 extends parallel to the outer side 22 of valve plate 17. However, adjacent the left post 32 and extending from the midpoint of the post over to the leg 68, the valve stop 65 has a reduced stop surface 85 which is substantially closer to the outer side 22 of valve plate 17 than is the main stop surface 83. Preferably, the spacing at stop surface 83 is at least twice the spacing at reduced stop surface 85. Intermediate between the two stop surfaces 83 and 85 is a sloping transition surface 86. The dimensions of the valve spring 54 and the two stop surfaces 83 and 85 are such that when the valve reed 46 is in the closed position as shown in FIG. 1, as occurs when the piston 13 is on the suction stroke, the bowed center section 62 is substantially depressed to provide tension on both ends of the valve reed 46 through its contact in the limited regions around the two posts 32 and 33. However, the spacing of the reduced stop surface 85 is such that it also compresses the bent tip 56 of the one end 57 of the valve spring to provide additional compression on the end 49 of valve reed 46 adjacent the left post 32. However, the spacing of the main stop surface 83 is such that the bent tip 61 of the other end 59 of valve spring 54 is spaced away from this surface, and therefore the biasing force on the other end 51 of the valve reed 46 adjacent the post 33 is less than that at the one end 49.

Figure 2:
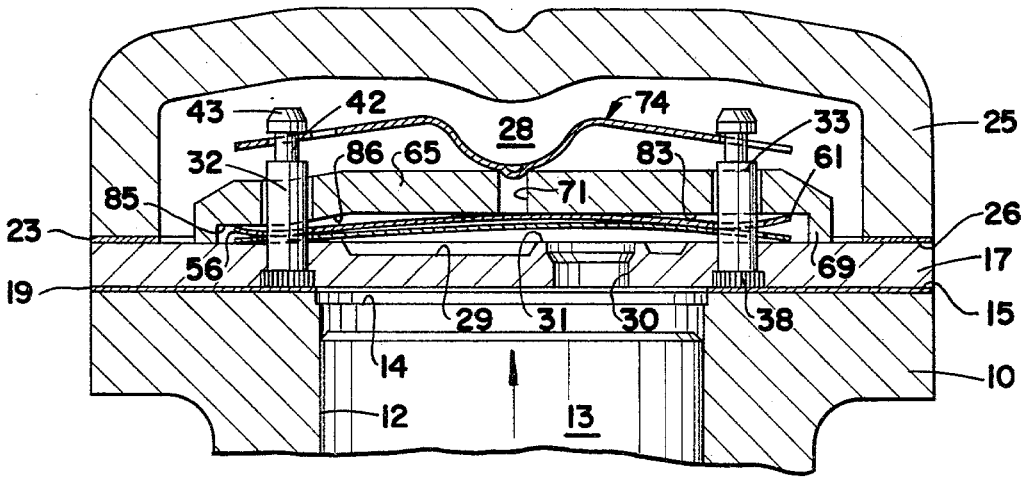
FIG. 2 is a view similar to FIG. 1, but showing the discharge valve when the piston is on the compression stroke, in which the valve is open to allow the gases in the cylinder to flow into the plenum.

When the discharge valve is fully opened, as shown in FIG. 2, near the end of the compression stroke of piston 13, the valve reed 46 is in the maximum open position, where the gas exhausting through the discharge port 30 lifts the valve reed at this point a maximum distance away from the valve seat 31, and hence the outer side 22 of valve plate 17. Because the valve spring 54 can flatten against the stop surface 83, it will be seen that the maximum lift of the valve reed 46 at this point is equal to the spacing between the stop surface 83 and the valve plate surface 22 less the combined thickness of the valve reed 46 and valve spring 54. Since the discharge port 30 is not centrally located with respect to the posts 32 and 33, it is clear that both the valve spring 54 and valve reed 46 can deflect a substantial distance about the post 33, while there will be substantially no deflection or upward movement of the valve reed 46 adjacent the other post 32. As the valve reed 46 moves upwardly from the position of FIG. 1 to the position of FIG. 2, the compression the valve reed 46 exerts on the valve spring 54 will initially cause the valve spring 54 to deflect by bending about the bowed center section 65 until the valve reed reaches a partially open position where the bent tip 61 on the other end 59 of the valve spring 54 engages the stop surface 83. At this point, the biasing force exerted by the valve spring 54 substantially increases as the valve reed 46 reaches the fully open position shown in FIG. 2. This increased biasing force comes into effect only when the valve reed has started its opening movement so that the valve reed 46 is able to open quite quickly after the pressure in the cylinder 12 exceeds that in the plenum 28. Likewise, the increasing biasing force provided by the contact of the bent tip 61 of the other end 59 of the valve spring 54 against the stop surface 83 prevents any slapping movement as the valve reed reaches the fully opened position and provides an increased closing force on the valve reed 46 as the piston 13 reverses itself at the end of the compression stroke. As the valve reed 46 then starts to close, the biasing force exerted by the valve spring 54 reduces in a nonlinear manner as the tip 61 or other end 59 moves out of contact against the stop surface 83. Thus, when the valve reed 46 closes, the biasing force is minimal, which tends to reduce the slapping force of the valve reed 46 against the outer side surface 82 of the valve plate 17. Thus, the noise produced by movement of the valve reed 46 tends to be reduced and the valve reed 46, when fully open, has a high clearance from the valve seat 31 to provide a minimum of restriction against the exhaust gases, while providing fast response time for opening and closing of the valve reed 46, to maximize the volumetric efficiency of the compressor. Furthermore, it should be noted that as the valve reed 46 opens and closes, there will be a slight sliding action between the valve spring 54 and the valve reed 46, and this sliding action, while constituting a slight amount of friction, combined with the area contact between the valve reed 46 and the valve spring 54 in the open position, provides a damping action which tends to prevent vibration from occurring in either the valve reed 46 or valve spring 54 while the compressor is in normal operation.

Although a preferred embodiment of this invention has been shown and described, it should be understood that various modifications and rearrangements of parts may be resorted to without departing from the scope of the invention as defined in the claims.

What is claimed is:

1. A discharge valve for a refrigeration compressor comprising a valve plate defining a substantially flat, planar surface, a single discharge port in said valve plate, said port defining a valve seat coplanar with said valve plate surface, a flat, elongated valve reed having first and second ends, said valve reed being normally in contact with said valve plate surface and in sealing engagement with said valve seat, said valve reed being positioned so that said valve seat is closer to said second end that to said first end, a valve spring substantially coextensive with and overlying said valve reed, said valve spring being of sheet material with the middle portion being bowed upwardly away from said valve reed and with the ends in abutting engagement with said valve reed, and a stop member fixedly mounted with respect to said valve plate and having a stop surface overlying said valve spring and in abutting engagement with said bowed portion of said valve spring, the portion of said stop surface adjacent said second end of said valve reed being spaced further from said valve plate surface than the portion of said stop surface adjacent said first end of said valve reed.

2. A discharge valve as set forth in claim 1, wherein said valve spring has at each end a bent tip bowed upwardly away from said valve reed.

3. A discharge valve as set forth in claim 2, wherein when said valve reed is in the closed position in sealing engagement with said valve seat, said bent tip of said valve spring adjacent said first end of said valve reed is in contact with said stop surface and said bent tip of said valve spring at said second end of said valve reed is spaced from said stop surface.

4. A discharge valve as set forth in claim 3, wherein said bent tip of said valve spring at said second end of said valve reed engages said stop surface when said valve reed is fully open away from said valve seat.

5. A discharge valve for a refrigeration compressor comprising a valve plate defining a substantially flat, planar surface, first and second guideposts secured to said valve plate and projecting upwardly normal to said planar surface, a single discharge port in said valve plate between said posts and collinear therewith, said port being closer to said second post than to said first post, said port defining a valve seat coplanar with said valve plate surface, a flat valve reed in guiding engagement with said guideposts and normally in contact with said valve plate surface and in sealing engagement with said valve seat, a valve spring in guiding engagement with said guideposts above said valve reed, said valve spring being of sheet material with the portion between said guideposts being bowed upwardly and with the ends adjacent said guideposts being in abutting engagement with said valve reed, and a stop member fixedly mounted with respect to said valve plate and having a stop surface extending between said guideposts above said valve spring and in abutting engagement with said bowed portion of said valve spring, the portion of said stop surface adjacent said second guide post being spaced further from said valve plate surface than the portion adjacent said first guideposts.

6. A discharge valve as set forth in claim 5, wherein said valve spring has bent tip portions at each end outward of the adjacent guidepost and bent upwardly from said valve reed.

7. A discharge valve as set forth in claim 6, wherein when said valve reed is in the closed position, said bent tip adjacent said first guidepost is in contact with said stop surface, and said bent tip adjacent said first guidepost is spaced from said stop surface.

8. A discharge valve as set forth in claim 7, wherein said bent tip of said valve spring adjacent said second guidepost engages said stop surface when said valve reed is fully open away from said valve seat.

9. A discharge valve as set forth in claim 8, wherein the spacing of said stop surface at said second guidepost is at least twice the spacing of said stop surface at said first guidepost.

* * * * *